US011660481B2

(12) United States Patent
Kang

(10) Patent No.: US 11,660,481 B2
(45) Date of Patent: May 30, 2023

(54) FIRE EXTINGUISHING SYSTEM FOR VEHICLE

(71) Applicants: HYUNDAI MOTOR COMPANY, Seoul (KR); KIA MOTORS CORPORATION, Seoul (KR)

(72) Inventor: Kyung Wan Kang, Jeonju-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 290 days.

(21) Appl. No.: 17/142,387

(22) Filed: Jan. 6, 2021

(65) Prior Publication Data

US 2022/0016456 A1 Jan. 20, 2022

(30) Foreign Application Priority Data

Jul. 20, 2020 (KR) ..... 10-2020-0089347

(51) Int. Cl.
*A62C 3/07* (2006.01)
*A62C 37/44* (2006.01)
*A62C 35/02* (2006.01)

(52) U.S. Cl.
CPC ..... *A62C 3/07* (2013.01); *A62C 35/023* (2013.01); *A62C 37/44* (2013.01)

(58) Field of Classification Search
CPC ..... A62C 35/15; A62C 35/645; A62C 35/064; A62C 35/07; A62C 35/68; A62C 35/02; A62C 35/023; A62C 35/11; A62C 35/13; A62C 37/44; A62C 37/46; A62C 37/48; A62C 13/00; A62C 13/62; A62C 13/64; A62C 13/66; A62C 3/07
See application file for complete search history.

(56) References Cited

U.S. PATENT DOCUMENTS

| | | | | |
|---|---|---|---|---|
| 6,059,046 | A * | 5/2000 | Lowry | A62C 37/10 169/61 |
| 9,974,991 | B2 * | 5/2018 | Ernfjäll | A62C 37/44 |
| 2016/0074686 | A1 * | 3/2016 | Taniguchi | A62C 13/62 169/9 |
| 2016/0279453 | A1 | 9/2016 | Ernfjall | |

FOREIGN PATENT DOCUMENTS

| | | |
|---|---|---|
| KR | 10-0930034 B1 | 12/2009 |
| KR | 10-1332328 B1 | 11/2013 |
| KR | 10-1649320 B1 | 8/2016 |

* cited by examiner

*Primary Examiner* — Christopher R Dandridge
(74) *Attorney, Agent, or Firm* — Morgan, Lewis & Bockius LLP

(57) ABSTRACT

A fire extinguishing system for a vehicle includes: a fire sensing line arranged in a predetermined space of the vehicle to output a fire sensing signal as an electrical signal when a fire is sensed; a controller configured to output a control signal for spraying a fire extinguishing agent when the fire sensing signal from the fire sensing unit is input; a fire extinguishing agent cylinder configured to discharge the fire extinguishing agent filling an inside thereof in response to the control signal output from the controller; and a spray nozzle assembly arranged in the predetermined space of the vehicle and configured to spray the fire extinguishing agent supplied from the fire extinguishing agent cylinder through a fire extinguishing agent hose.

16 Claims, 11 Drawing Sheets

FIG. 1 –PRIOR ART-
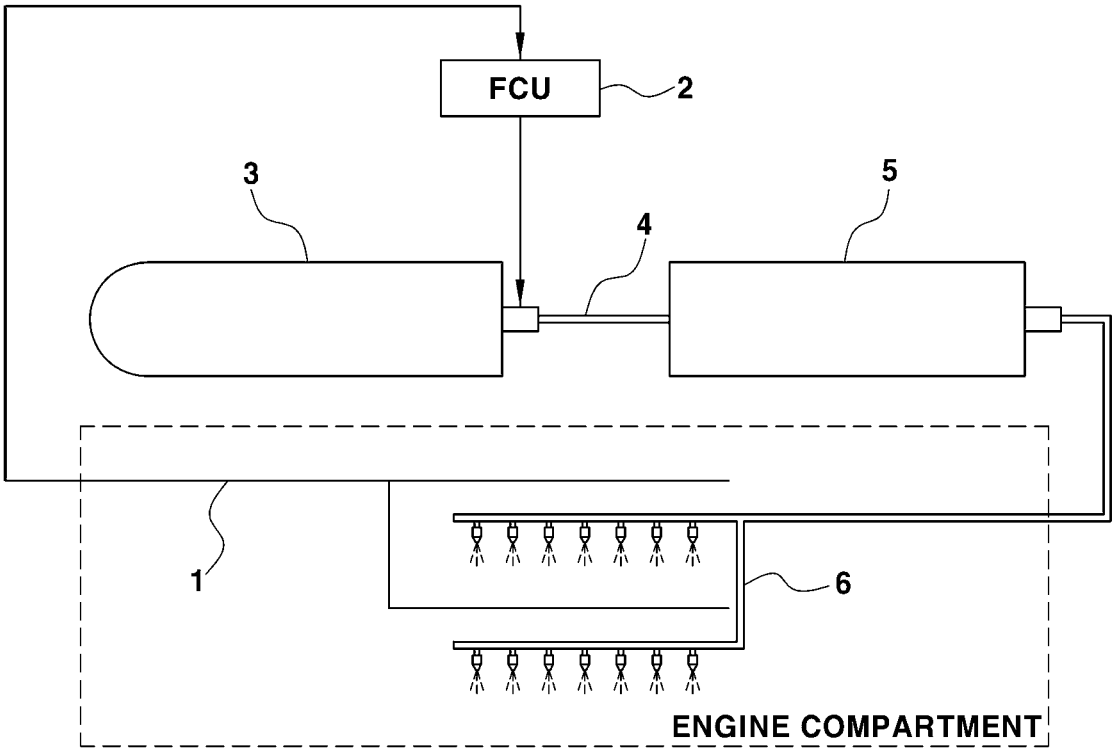
FIG. 2 –PRIOR ART-
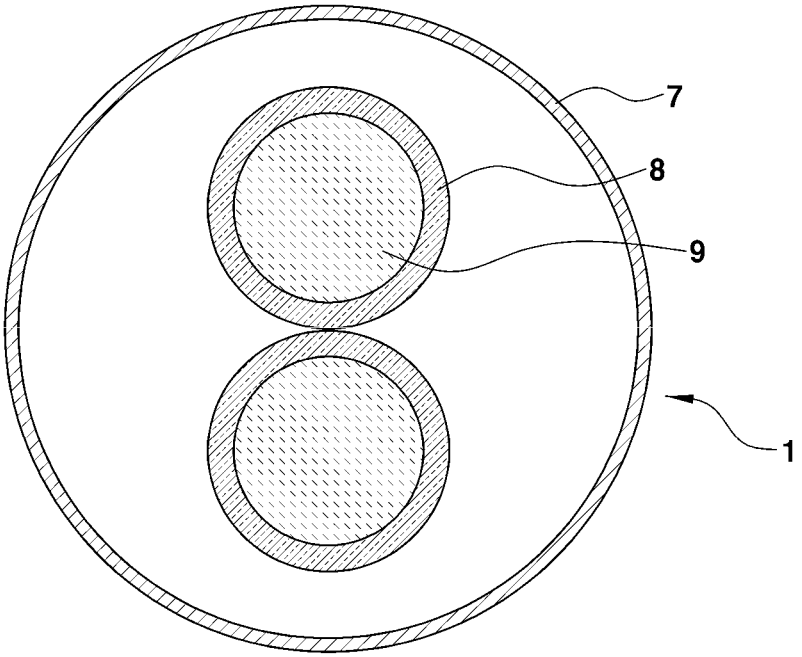

FIRE EXTINGUISHING SYSTEM FOR VEHICLE

CROSS-REFERENCE TO RELATED APPLICATION

This application claims the benefit of priority to Korean Patent Application No. 10-2020-0089347 filed on Jul. 20, 2020 in the Korean Intellectual Property Office, the entire contents of which are incorporated herein by reference.

TECHNICAL FIELD

The present disclosure relates to a fire extinguishing system for a vehicle, and more particularly, to a fire extinguishing system for a vehicle which may automatically sense outbreak of a fire in the vehicle to rapidly and effectively extinguish the fire.

BACKGROUND

In general, since a fuel, which is a flammable material, is used, a plurality of heat sources are present, and various electric wires, which intersect each other in a complicated arrangement, are installed in vehicles, there is a risk of fires.

For example, a high-temperature engine and various electric apparatuses, which are installed in an engine compartment, may be damaged or malfunction due to a vehicle crash and may cause a fire.

In addition, there is a risk of fires in the engine compartment even during driving due to overheating of the engine and an exhaust gas after-treatment process.

Recently, with increased use of environmentally friendly vehicles, the risk of fires due to application of external impacts or internal short circuits of a battery or high-voltage electric wiring has also increased.

However, the use of a fire extinguisher provided in the vehicle is widely known as a method for responding to a fire, and if a driver cannot use the fire extinguisher at the appropriate time, the driver fails to extinguish the fire at an early stage, and thus the fire may spread throughout the vehicle.

Further, public transportation vehicles, such as buses, which carry many passengers, essentially require rapid fire prevention for passenger safety, and when an initial response to a fire fails, a great tragedy may result.

Moreover, a driver is present inside a vehicle during driving and thus has difficulty perceiving outbreak of a fire in an engine compartment before a great amount of smoke is generated, and particularly, an engine compartment is located at the rear portion of a bus, unlike cars, and thus a bus driver has greater difficulty perceiving outbreak of a fire in the engine compartment.

Therefore, when the driver fails to rapidly extinguish the fire at an early stage, the fire may spread, thereby causing complete combustion of the vehicle and increasing the risk of loss of life.

Further, even if the driver or passengers inside the vehicle quickly notice outbreak of the fire, they have difficulty rapidly extinguishing the fire at the early stage using only the small fire extinguisher provided in the vehicle.

Accordingly, an engine compartment fire extinguishing system, which rapidly extinguishes a fire at an early stage by automatically spraying a fire extinguishing agent onto a point of ignition when outbreak of the fire in an engine compartment is sensed, is widely known.

In the known engine compartment fire extinguishing system, when a fire breaks out in an engine compartment, high-pressure nitrogen filling a nitrogen tank is supplied to a cylinder filled with a fire extinguishing agent through a hose in response to a fire sensing signal.

Then, a piston is operated by the high-pressure nitrogen in the cylinder, and the fire extinguishing agent at a high pressure is supplied to a spray line by the pushing force of the piston and is sprayed onto a point of ignition through nozzles of the spray line, thereby extinguishing the fire.

In the above-described engine compartment fire extinguishing system, the high-pressure nitrogen is used as gas for operating the piston, and a high-pressure supply hose connects the tank filled with the high-pressure nitrogen to the cylinder filled with the fire extinguishing agent.

Further, the spray line connected to the cylinder is disposed along a predetermined position in the engine compartment, and a fire sensing line configured to sense fires in the engine compartment is also disposed along a predetermined position.

The above-described conventional fire extinguishing system is effective in extinguishing a fire in an inner space provided in a vehicle, such as an engine compartment.

For example, the fire sensing line disposed in the inner space provided in the vehicle, such as the engine compartment, automatically senses a fire breaking out in the space, and the fire extinguishing agent in the cylinder is sprayed through the nozzles of the spray line disposed in the space, thereby being capable of extinguishing the fire in the compartment at an early stage.

However, the above-described fire extinguishing system requires to separately store the high-pressure nitrogen in the vehicle, and thus requires the expensive nitrogen tank configured to store the high-pressure nitrogen and further requires the high-pressure supply hose configured to connect the nitrogen tank to the cylinder filled with the fire extinguishing agent.

Further, even when the nitrogen tank is filled with the high-pressure nitrogen, it may be difficult to maintain the pressure state of the nitrogen in the tank for a long time, and a pressure drop may occur in the tank due to leakage of the high-pressure nitrogen and thus the fire extinguishing system may malfunction depending on the state of the nitrogen when a fire actually breaks out, thereby deteriorating the operational reliability of the fire extinguishing system.

In addition, in the conventional engine compartment fire extinguishing system using high-pressure nitrogen as the operating gas, both the tank filled with nitrogen and the cylinder filled with the fire extinguishing agent (the fire extinguishing agent cylinder) are disposable, and must be replaced with new ones, if reused.

Moreover, in the conventional engine compartment fire extinguishing system, the fire sensing line is configured such that two electrically conductive wires respectively covered with a covering material, are inserted into a conduit formed of a synthetic resin (for example, PVC).

In such a fire sensing line, a temperature range within which it is detected that a fire has broken out is set depending on heat-resistant temperature characteristics of the outer conduit.

Therefore, to respond to a required temperature range within which it is detected that a fire has broken out, various temperature conditions of several spaces in a vehicle in which fires break out (for example, an engine compartment or a space at the side of a tire), or various temperature conditions of a region more sensitive to heat (for example, near a turbocharger) and a region less sensitive to heat (for example, near an air cleaner) in the same space, such as the engine compartment, different heat-resistant temperature characteristics or different materials and configurations of the fire sensing line need to be applied depending on the mounting position of the fire sensing line in the vehicle and usage conditions, such as the temperature of a space in which the fire sensing line is mounted or a required temperature to detect a fire.

Further, to prevent the fire extinguishing system from malfunctioning, it is required to increase rigidity of the fire sensing line and to improve durability of the fire sensing line.

The above information disclosed in this Background section is only for enhancement of understanding of the background of the disclosure and therefore it may contain information that does not form the prior art that is already known in this country to a person of ordinary skill in the art.

SUMMARY OF THE DISCLOSURE

The present disclosure has been made in an effort to solve the above-described problems associated with the prior art, and it is an object of the present disclosure to provide a fire extinguishing system for vehicles which may automatically sense outbreak of a fire in a vehicle to rapidly and effectively extinguish the fire and to greatly reduce installation cost and maintenance cost.

It is another object of the present disclosure to provide a fire sensing line used in a fire extinguishing system for a vehicle, which may differentiate heat-resistant temperature characteristics depending on the mounting position of the fire sensing line in the vehicle and usage conditions, such as the temperature of a space in which the fire sensing line is mounted or a required temperature to detect a fire, without changing a material which is used for the fire sensing line and the configuration of the fire sensing line, and may adjust a sensed temperature range depending on the usage conditions.

It is yet another object of the present disclosure to prevent a fire extinguishing system from malfunctioning and to improve operational reliability of the fire extinguishing system through improvement of rigidity and durability of a fire sensing line.

In one aspect, the present disclosure provides a fire extinguishing system for a vehicle including: a fire sensing line arranged in a predetermined space of a vehicle to output a fire sensing signal as an electrical signal when a fire is sensed; a controller configured to output a control signal for spraying a fire extinguishing agent when the fire sensing signal from the fire sensing unit is input; a fire extinguishing agent cylinder configured to discharge the fire extinguishing agent filling an inside thereof in response to the control signal output from the controller; and a spray nozzle assembly arranged in the predetermined space of the vehicle and configured to spray the fire extinguishing agent supplied from the fire extinguishing agent cylinder through a fire extinguishing agent hose, wherein the fire sensing line includes: a tube including a first hollow part and a second hollow part defined therein to extend in a length direction of the tube; two electrically conductive wires disposed along the first hollow part to be respectively covered with a covering material to be electrically isolated from each other, and configured to be short-circuited when external current is applied thereto and configured to input a short-circuit signal as the fire sensing signal to the controller; a coil arranged to receive current from the controller, and disposed in the length direction of the tube inside or outside the tube; a magneto-rheological (MR) fluid configured to fill an inside of the sealed second hollow part of the tube; and an outer conduit disposed to surround the tube.

Other aspects and preferred embodiments of the disclosure are discussed infra.

The above and other features of the disclosure are discussed infra.

BRIEF DESCRIPTION OF THE DRAWINGS

The above and other features of the present disclosure will now be described in detail with reference to certain exemplary embodiments thereof illustrated in the accompanying drawings which are given hereinbelow by way of illustration only, and thus are not limitative of the present disclosure, and wherein:

FIG. 1 is a block diagram illustrating a conventional engine compartment fire extinguishing system;

FIG. 2 is a cross-sectional view illustrating the inner configuration of a conventional fire sensing line;

Figure 3:
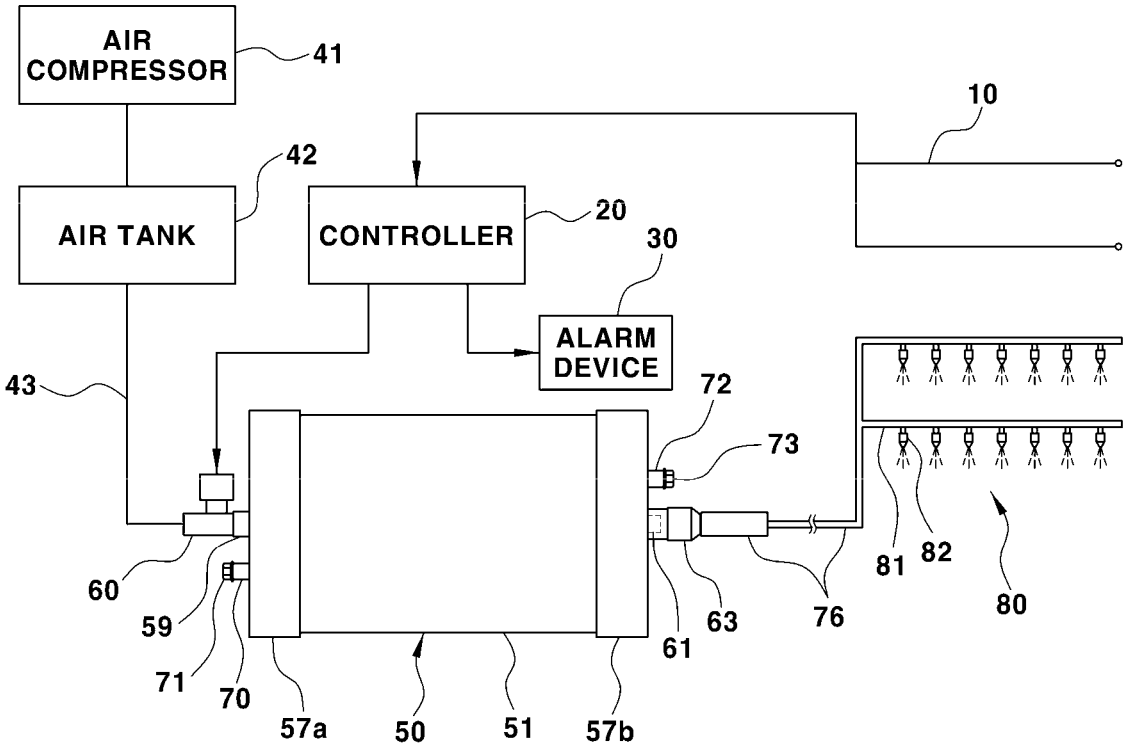
FIG. 3 is an overall block diagram illustrating a fire extinguishing system according to one embodiment of the present disclosure.

It should be understood that the appended drawings are not necessarily to scale, presenting a somewhat simplified representation of various preferred features illustrative of the basic principles of the disclosure. The specific design features of the present disclosure as disclosed herein, including, for example, specific dimensions, orientations, locations, and shapes, will be determined in part by the particular intended application and use environment.

In the figures, reference numbers refer to the same or equivalent parts of the present disclosure throughout the several figures of the drawings.

DETAILED DESCRIPTION

Hereinafter reference will be made in detail to various embodiments of the present disclosure, examples of which are illustrated in the accompanying drawings and described below. While the disclosure will be described in conjunction with exemplary embodiments, it will be understood that the present description is not intended to limit the disclosure to the exemplary embodiments. On the contrary, the disclosure is intended to cover not only the exemplary embodiments, but also various alternatives, modifications, equivalents and other embodiments, which may fall within the spirit and scope of the disclosure as defined by the appended claims.

In the following description of the embodiments, it will be understood that, when a part is said to "include" an element, the part may further include other elements, and does not exclude the presence of other elements unless stated otherwise.

The present disclosure aims to provide a fire extinguishing system for vehicles which may automatically sense outbreak of a fire in a vehicle to rapidly and effectively extinguish the fire and to greatly reduce installation cost and maintenance cost.

Further, the present disclosure aims to provide a fire sensing line used in the fire extinguishing system for vehicles, which may differentiate heat-resistant temperature characteristics depending on the mounting position of the fire sensing line in a vehicle and usage conditions, such as the temperature of a space in which the fire sensing line is mounted or a required temperature to detect a fire, without changing a material which is used for the fire sensing line and the configuration of the fire sensing line, and may adjust the sensed temperature range and rigidity of the fire sensing line depending on the usage conditions.

In addition, the present disclosure aims to prevent the fire extinguishing system from malfunctioning and to improve operational reliability of the fire extinguishing system through improvement of rigidity and durability of the fire sensing line.

The fire extinguishing system according to the present disclosure may be installed in a designated space provided in a vehicle, in which a fire has the potential to break out, and serve to extinguish a fire breaking out in an engine compartment of the vehicle, and more particularly, may be configured to automatically extinguish a fire breaking out in an engine compartment provided at the rear portion of a bus.

The fire extinguishing system may be installed in a car having an engine compartment provided at the front portion thereof, or be installed to extinguish a fire breaking out in a designated space provided in a vehicle other than the engine compartment thereof.

First, to help understanding of the present disclosure, a conventional fire extinguishing system will be described as follows.

FIG. 1 is a block diagram illustrating a conventional fire extinguishing system and, as shown in this figure, the conventional fire extinguishing system includes a fire sensing line 1 installed in a space inside a vehicle, for example, in an engine compartment, a fire control unit (FCU) 2 configured to output a control signal for spraying a fire extinguishing agent when a fire sensing signal is received from the fire sensing line 1, and a nitrogen tank 3 provided to store high-pressure nitrogen, which is operating gas, and to discharge the high-pressure nitrogen by opening an outlet in response to the control signal output from the FCU 2.

In addition, the conventional fire extinguishing system includes a fire extinguishing agent cylinder 5 provided to store a fire extinguishing agent and to discharge the fire extinguishing agent by operating a piston provided therein using the high-pressure nitrogen supplied from the nitrogen tank 3, a high-pressure supply hose 4 installed to connect the nitrogen tank 3 to the fire extinguishing agent cylinder 5 to supply the high-pressure nitrogen, and a spray nozzle assembly 6 installed inside the engine compartment and provided to spray the fire extinguishing agent supplied from the fire extinguishing agent cylinder 5.

In the above conventional fire extinguishing system, if a fire breaks out in the engine compartment, the fire sensing signal generated by the fire sensing line 1 is transmitted to the FCU 2.

The fire sensing line 1 is installed in a space inside the vehicle, for example, installed at a predetermined position along a predetermined path inside the engine compartment, and is connected to the FCU 2 to transmit the fire sensing signal to the FCU 2.

FIG. 2 is a cross-sectional view illustrating the inner configuration of the conventional fire sensing line 1 and, as shown in this figure, the conventional fire sensing line 1 has a structure in which two electrically conductive wires 9 respectively covered with a covering material 8 are inserted into a conduit 7 formed of a synthetic resin (for example, PVC).

When a fire breaks out in the space in which the fire sensing line 1 is installed, and the conduit 7 and the covering material 8 of the fire sensing line 1 are burned and therefore melted by flames, the electrically conductive wires 9 are exposed to the outside and thus contact each other, thereby causing an electrical short-circuit.

The FCU 2 simultaneously applies current to the electrically conductive wires 9 and receives a current signal flowing along the electrically conductive wires 9 or a voltage signal applied between the two electrically conductive wires 9, and, when a short-circuit occurs between the two electrically conductive wires 9, over-current flows along the electrically conductive wires 9, and the FCU 2 senses short circuit current or short circuit voltage and thus recognizes outbreak of the fire.

The sensed short circuit current or short circuit voltage serves as a kind of electrical signal indicating outbreak of the fire, i.e., the fire sensing signal, and the FCU 2 recognizes from the fire sensing signal transmitted from the fire sensing line 1 that the fire breaks out inside the engine compartment.

However, the conventional fire sensing line 1 must be manufactured to have different heat-resistant temperature characteristics of the conduit 7 or use different materials or configurations of the conduit 7 depending on the mounting position of the fire sensing line 1 in the vehicle and usage conditions, such as the temperature of the space in which the fire sensing line 1 is mounted or a required temperature to detect a fire.

The FCU 2, which has recognized outbreak of the fire, outputs an electrical signal, i.e., a control signal for spraying the fire extinguishing agent, and applies the electrical signal to the nitrogen tank 3.

Then, in the nitrogen tank 3, in response to the control signal output from the FCU 2, a pin mounted in a cap of the nitrogen tank 3 is operated to puncture a metal membrane at a tank outlet, and then, the tank outlet is opened and the high-pressure nitrogen in the tank 3 is transmitted to the fire extinguishing agent cylinder 5 through the high-pressure supply hose 4.

Subsequently, in the fire extinguishing agent cylinder 5, the piston is moved to pressurize the fire extinguishing agent through the operation of the high-pressure nitrogen supplied from the nitrogen tank 3, the fire extinguishing agent is supplied to the spray nozzle assembly 6 through the outlet of the fire extinguishing agent cylinder 5, and consequently, the fire extinguishing agent may be sprayed into the inside of the engine compartment through nozzles of the spray nozzle assembly 6.

In the above configuration, the metal membrane installed at the outlet of the nitrogen tank 3 is torn by the pin to discharge the high-pressure nitrogen therethrough, and thus, the nitrogen tank 3 cannot be reused before it is replaced.

In the same manner, the fire extinguishing agent cylinder 5 has a structure in which a metal membrane is installed at an outlet and the metal membrane is punched to discharge the fire extinguishing agent therethrough, and thus, the fire extinguishing agent cylinder 5 cannot be reused also.

In the conventional fire extinguishing system, both the nitrogen tank 3 and the fire extinguishing agent cylinder 5 must be replaced after they are used once, and the number of parts which are required is large due to installation accessories, such as the nitrogen tank 3, the high-pressure supply hose, brackets, etc.

Further, since vibration and impact occur in the vehicle and the nitrogen tank 3 remains filled with the high-pressure nitrogen from when the nitrogen tank 3 is initially mounted in the vehicle, nitrogen leakage from the nitrogen tank 3 may occur due to external influences, such as vibration and impact, and thereby, the nitrogen tank 3 may not appropriately function when a fire breaks out in the state in which the pressure of the nitrogen in the nitrogen tank 3 is lowered.

Therefore, to solve the above problems attributable to the use of high-pressure nitrogen as operating gas, an improved fire extinguishing system, which uses compressed air rather than high-pressure nitrogen as operating gas, is disclosed.

Further, a fire extinguishing system using an improved fire sensing line is disclosed.

Figure 4:
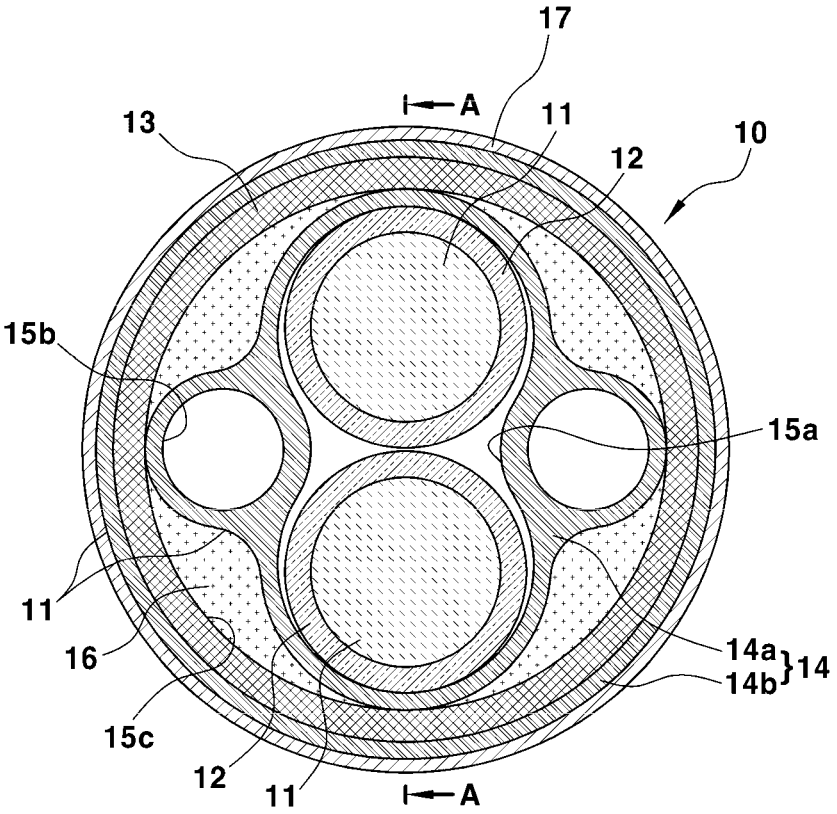
FIG. 4 is a cross-sectional view illustrating the inner configuration of a fire sensing line in the fire extinguishing system according to one embodiment of the present disclosure.
Figure 5:
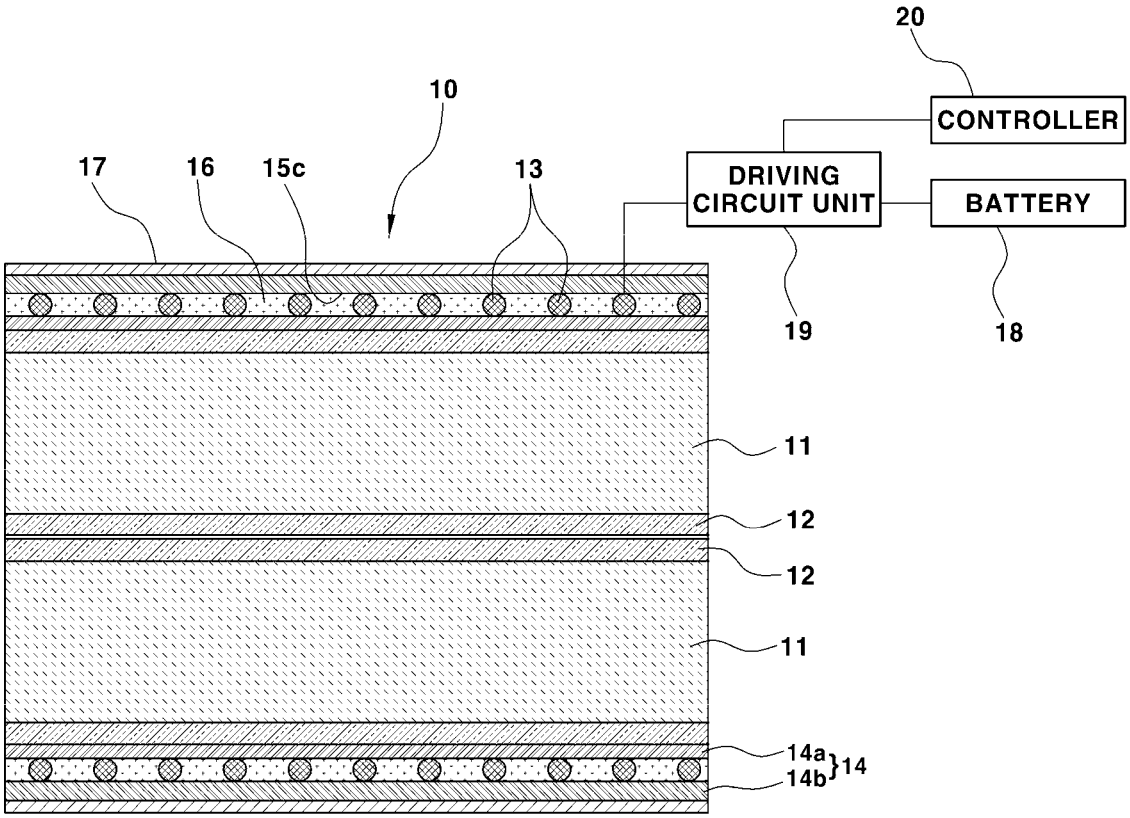
FIG. 5 is a longitudinal-sectional view of the fire sensing line taken along line A-A' of FIG. 4.

FIG. 3 is an overall block diagram illustrating a fire extinguishing system according to one embodiment of the present disclosure, FIG. 4 is a cross-sectional view illustrating the inner configuration of a fire sensing line in the fire extinguishing system according to one embodiment of the present disclosure, and FIG. 5 is a longitudinal-sectional view of the fire sensing line taken along line A-A' of FIG. 4.

In the present disclosure, compressed air is used as operating gas instead of high-pressure nitrogen and, for this purpose, an air tank 42, which is already mounted in a vehicle, is used, as shown in these figures.

The air tank 42 stores air compressed by an air compressor 41 at a high pressure (for example, 10 bar), and the air tank 42 and the air compressor 41, which are already mounted in the vehicle, may be used.

As is well known, the air compressor 41 and the air tank 42 are mounted in a commercial vehicle, such as a truck or a bus, and are used to operate a cab, a suspension, a brake, etc. of the vehicle.

If the air tank 42 which is already mounted in the vehicle is used as a supply source of the operating gas, peripheral parts, such as an expensive high-pressure tank, a bracket, etc., are not separately provided and thus installation cost may be greatly reduced.

Referring to FIG. 3, the fire extinguishing system according to one embodiment of the present disclosure includes a fire sensing unit 10 installed in a predetermined space in the vehicle, for example, an engine compartment, a controller 20 configured to output a control signal for spraying a fire extinguishing agent when a fire sensing signal is received from the fire sensing unit 10, and the air tank 42 configured to store compressed air serving as the operating gas.

In addition, the fire extinguishing system according to one embodiment of the present disclosure includes a fire extinguishing agent cylinder 50 provided to store a fire extinguishing agent and to discharge the fire extinguishing agent by operating a piston 74 (see FIG. 9) provided therein using the compressed air supplied from the air tank 42 through an air hose 43, and a spray nozzle assembly 80 installed inside the engine compartment and provided to spray the fire extinguishing agent supplied from the fire extinguishing agent cylinder 50 through a fire extinguishing agent hose 76.

First, the fire sensing unit 10 may be a fire sensing line and the inner configuration of the fire sensing line according to one embodiment of the present disclosure may be exemplarily illustrated in FIG. 4.

In one embodiment of the present disclosure, the fire sensing line 10 may be a variable rigidity type, and the variable rigidity-type fire sensing unit 10 includes electrically conductive wires 11 connected to the controller 20, a coil 13 to which current is applied by the controller 20, a tube 14 filled with a magneto-rheological (MR) fluid 16, and an outer conduit 17 used as the outermost element.

As shown in FIG. 4, the fire sensing line 10 has a structure in which two electrically conductive wires 11 respectively covered with a covering material 8 to be electrically insulated from each other and be adjacent to the each other in parallel are disposed in the center of the inside of the fire sensing line 10, and the two electrically conductive wires 11 are surrounded by the tube 14 in the cross-section of the fire sensing line 10.

Here, the two electrically conductive wires 11 are disposed in the tube 14 to extend in the length direction, and the two electrically conductive wires 9 are inserted into a first hollow part 15*a* which is an empty space provided in the center of the tube 14 in the cross-section of the fire sensing line 10.

The first hollow part 15*a* is an empty space extending in the length direction of the tube 14.

Further, the tube 14 is inserted into the outer conduit 17 so that the outer conduit 17 surrounds the outer circumferential surface of the tube 14. Here, the outer conduit 17 may be manufactured to have a circular tube shape using a nonconductive synthetic resin, such as polyvinyl chloride (PVC).

The tube 14 may be manufactured using a flexible and elastic material, for example, rubber or silicone, and subsidiary hollow parts, which are other empty spaces disposed parallel to each other at the left and right sides of the first hollow part 15*a* separately from the first hollow part 15*a*, i.e., third hollow parts 15*b*, are formed in the tube 14.

In the tube 14, the first hollow part 15*a* and the third hollow parts 15*b* are empty spaces continuously extending in the length direction of the fire sensing line 10, the first hollow part 15*a* may have a cross-sectional shape into which the two covered electrically conductive wires 11 are inserted parallel to each other, and each of the third hollow parts 15*b* may have a circular cross-sectional shape.

The embodiment shown in FIG. 4 illustrates that a total of two third hollow parts 15*b* are formed, i.e., one third hollow part 15*b* is formed at each of the left and right sides of the cross-section of the fire sensing line 10, but this is merely one example, and one third hollow part 15*b* or a plurality of third hollow parts 15*b* may be formed.

Further, the coil 13 is spirally disposed throughout the entirety of the inner surface of the tube 14 in the length direction, and the coil 13 is disposed to spirally surround the two electrically conductive wires 11.

In addition, the coil 13 is provided to receive current only when the ignition of the vehicle is turned on under the control of the controller 20.

For this purpose, the coil 13 may be connected directly to the controller 20 to receive current from a battery 18, which is a vehicle power source, or be connected to a driving circuit unit 19, which is controlled by the controller 20, to receive current from the battery 18 through the driving circuit unit 19.

Here, the controller 20 is provided to variably control the magnitude of current applied to the coil 13.

A second hollow part 15*c* which is another empty space filled with the MR fluid 16 is formed in the tube 14, and the second hollow part 15*c* is provided to have a shape continuously extending in the length direction of the fire sensing line 10 within the tube 14.

The inside of the second hollow part 15*c* sealed in the tube 14 is filled with the MR fluid 16, the MR fluid 16 filling the tube 14 is disposed around the coil 13, and particles in the MR fluid 16 are moved by a magnetic field formed when current is applied to the coil 13.

Figure 6:
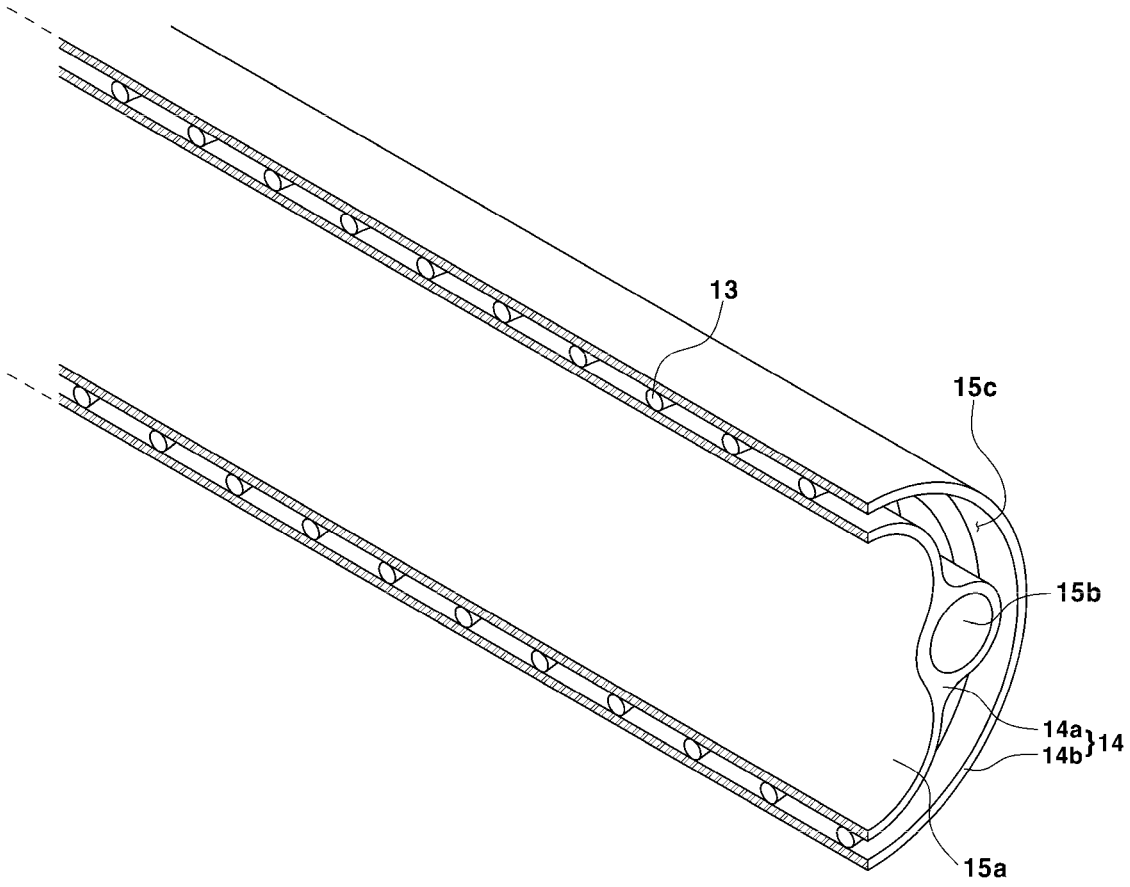
FIG. 6 is a view illustrating one example in which a coil is disposed on a tube of the fire sensing line in the fire extinguishing system according to one embodiment of the present disclosure.
Figure 7:
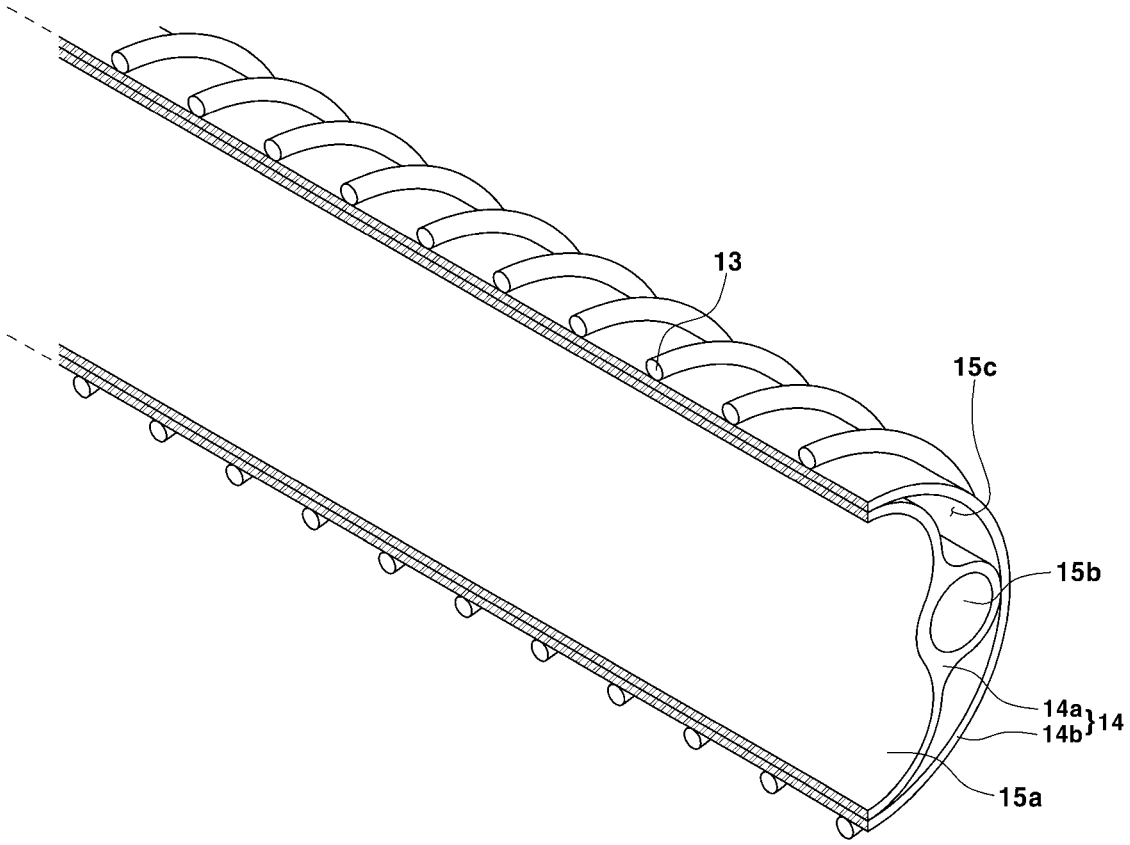
FIG. 7 is a view illustrating another example in which the coil is disposed on the tube of the fire sensing line in the fire extinguishing system according to one embodiment of the present disclosure.

FIG. 6 is a view illustrating one example in which the coil is disposed on the tube of the fire sensing line in the fire extinguishing system according to one embodiment of the present disclosure, and FIG. 7 is a view illustrating another example in which the coil is disposed on the tube of the fire sensing line in the fire extinguishing system according to one embodiment of the present disclosure.

In one embodiment of the present disclosure, the coil 13 may be spirally disposed inside the tube 14 in the length direction of the tube 14, as shown in FIG. 6, and be spirally disposed outside the tube 14 in the length direction of the tube 14, as shown in FIG. 7.

FIG. 6 illustrates an example in which the coil 13 is installed in the second hollow part 15*c* of the tube 14 in the fire sensing line, and the coil 13 may be installed inside the tube 14 to be spirally disposed, and particularly, the spirally wound coil 13 may be disposed inside the second hollow part 15*c* of the tube 14.

Here, the tube 14 may be configured to have a double-tube structure having a designated cross-sectional shape, which includes an inner tube 14*a* and an outer tube 14*b*, as shown in FIG. 6.

With this configuration, a space between the inner tube 14*a* and the outer tube 14*b* serves as the second hollow part 15*c*, and the first hollow part 15*a* and the third hollow parts 15*b* are formed in the inner tube 14*a*.

The inner tube 14*a* and the outer tube 14*b* may be manufactured to have a designated cross-sectional shape through extrusion molding using a material, such as rubber or silicone, and, to manufacture the tube 14, the inner tube 14*a* and the outer tube 14*b* are manufactured and prepared to a necessary length, the inner tube 14*a* is inserted into the outer tube 14*b*, and the coil 13 which is spirally wound is inserted into the second hollow part 15*c* between the inner tube 14*a* and the outer tube 14*b*.

Thereafter, one end of the second hollow part 15*c* is sealed at designated ends of the two tubes 14*a* and 14*b* through a method, such as fusion, closing using a closing member, or compression, the inside of the second hollow part 15*c* is filled with the MR fluid 16 through the other end of the second hollow part 15*c*, and the other end of the second hollow part 15*c* is sealed through the same method.

Thereby, the tube 14, which is provided with the spirally disposed coil 13 and is filled with the MR fluid 16, may be manufactured, both ends of the coil 13 inserted into the tube 14 extend and are exposed to the outside through the sealed ends of the tube 14, and the exposed ends of the coil 13 are connected to the controller 20 or the driving circuit unit 19.

FIG. 7 illustrates an example in which the coil 13 is installed on the outer circumferential surface of the tube 14, the tube 14 is manufactured to have a necessary length and a designated cross-sectional shape through extrusion molding, as shown in this figure, the second hollow part 15*c* in the tube 14 is filled with the MR fluid 16, both ends of the tube 14 are sealed, and the coil 13 is spirally wound on the outer circumferential surface of the tube 14.

Thereafter, the electrically conductive wires 11 are inserted into the first hollow part 15*c* of the tube 14, and the tube 14 is inserted into the outer conduit 17, thereby completing manufacture of the fire sensing line 10.

Figure 8:
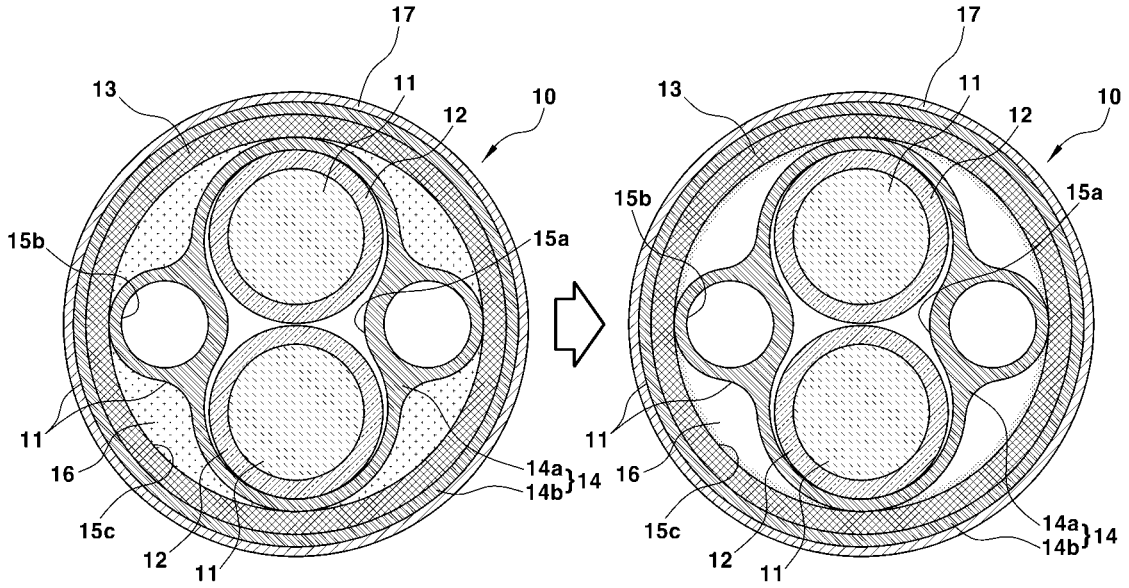
FIG. 8 cross-sectional views illustrating a state before current is applied to the coil of the fire sensing line and a state in which current is applied to the coil of the fire sensing line in the fire extinguishing system according to one embodiment of the present disclosure.

FIG. 8 is cross-sectional views illustrating a state before current is applied to the coil 13 of the fire sensing line 10 and a state in which current is applied to the coil 13 of the fire sensing line 10 in the fire extinguishing system according to one embodiment of the present disclosure.

FIG. 8 illustrates the state before current is applied to the coil 13 of the fire sensing line 10 (left figure) and the state in which current is applied to the coil 13 of the fire sensing line 10 (right figure). Before current is applied to the coil 13, particles (for example, coated iron powder) are uniformly dispersed in the MR fluid 16 filling the inside of the second hollow part 15*c*, but, when current is applied to the coil 13, a magnetic field is formed around the coil 13, and the particles in the MR fluid 16 are moved towards the coil 13 to be concentrated on the coil 13.

Thereby, the fire sensing line 10 including the tube 14 may have increased rigidity and be thus hardened, and the hardness and rigidity of the fire sensing line 10 may be adjusted depending on the magnitude of current applied to the coil 13 and the intensity of the magnetic field formed around the coil 13.

Alternatively, when the number of windings of the coil 13 or the pitch between the windings of the coil 13 is varied at the same length of the fire sensing line 10 by changing only the configuration of the coil 13 among the elements of the fire sensing line 10, the intensity of the magnetic field may be varied and thus the hardness and rigidity of the fire sensing line 10 may be adjusted.

In one embodiment of the present disclosure, the controller 20 may be set to apply current to the coil 13 in the fire sensing line 10 when power of the vehicle is turned on after starting the vehicle, and particularly, the controller 20 may apply current having a predetermined magnitude depending on the position of the fire sensing line 10 mounted in the vehicle.

As described above, the fire sensing line 10 adjusts the magnitude of current applied to the coil 13 by the controller 20 depending on usage conditions, and may thus adjust heat-resistant temperature characteristics and rigidity depending on the usage conditions, thereby being capable of differentiating heat-resistant temperature characteristics and rigidity depending on the mounting position of the fire sensing line 20 in the vehicle without changing the configuration of the fire sensing line 10 or a material which is used for the fire sensing line 10.

That is, the fire sensing line 10 has a double-tube structure (including the outer conduit and the tube) and adjusts the magnitude of current applied to the coil 13 and the intensity of the magnetic field formed around the coil 13 using the MR coil 16, thereby being capable of coping with various fire sensing conditions of vehicles and appropriately varying the rigidity of the fire sensing line 10 as needed.

For example, since the intensity of the magnetic field near a region more sensitive to heat (for example, near a turbocharger) may be increased to prevent malfunction and the intensity of the magnetic field near a region less sensitive to heat (for example, near an air cleaner) may be decreased, the fire sensing line 10 may be differentiated based on conditions, such as a fire outbreak temperature at the mounted position thereof, and sense various temperature conditions.

Further, the fire sensing line 10 may be differentiated based on the mounted position thereof in the vehicle and the usage conditions thereof by changing only the wound state of the coil 13 among the elements of the fire sensing line 10.

In addition, the conventional fire sensing line has a limited lifetime due to fatigue and consequent reduced durability, but the fire sensing line 10 according to the present disclosure having a double-tube structure is capable not only of increasing rigidity but also of enabling adjustment of rigidity, and thus realizes increase in rigidity and improvement of durability and a prolonged lifetime compared to the conventional fire sensing line.

In the fire extinguishing system according to one embodiment of the present disclosure, upon determining that a fire breaks out in the engine compartment, the controller 20 outputs a control signal for extinguishing the fire and spraying the fire extinguishing agent to simultaneously supply compressed air serving as the operating gas to an air chamber C1 of the fire extinguishing agent cylinder 50 and to supply the fire extinguishing agent stored in a fire extinguishing agent chamber C2 of the fire extinguishing agent cylinder 50 to the spray nozzle assembly 80.

Further, as described above, in the present disclosure, the compressed air is used as the operating gas, and the air tank 42 which is already mounted in the vehicle is used as an operating gas (compressed air) supply source.

The compressed air which is generated and supplied by the air compressor 41 is stored in the air tank 42 of the vehicle, and the air tank 42 is connected to an inlet of the fire extinguishing agent cylinder 50 by the air hose 43.

Figure 9:
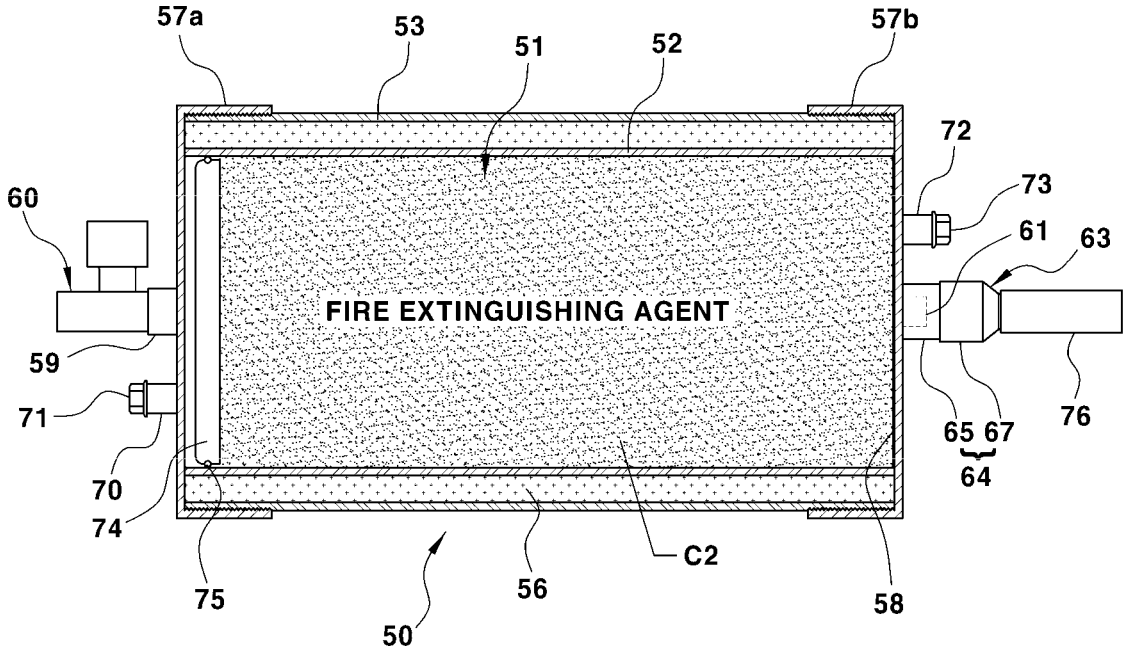
FIGS. 9 and 10 are views illustrating an operating gas supply source and a fire extinguishing agent cylinder in the fire extinguishing system according to one embodiment of the present disclosure.
Figure 10:
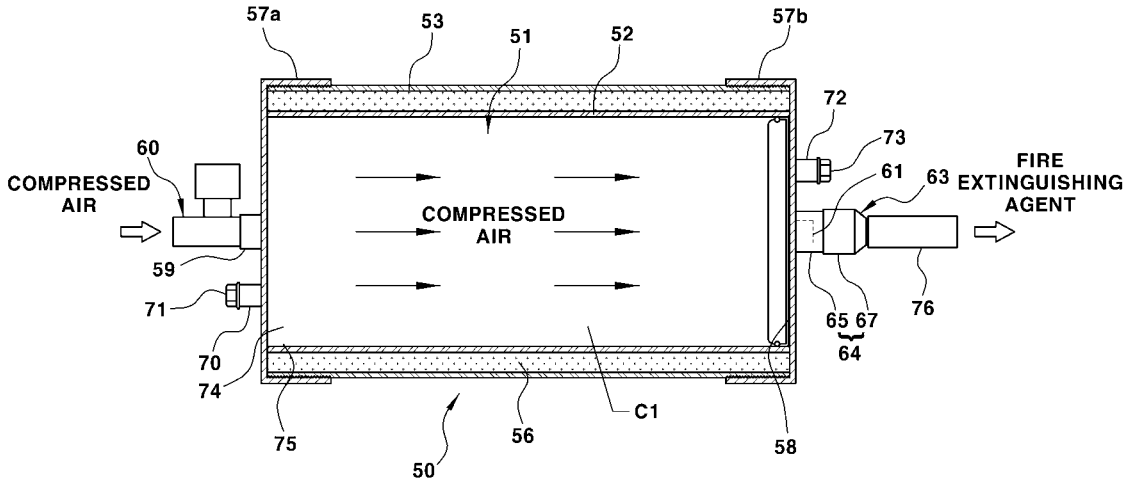

FIGS. 9 and 10 are views illustrating the operating gas supply source and the fire extinguishing agent cylinder in the fire extinguishing system according to one embodiment of the present disclosure.

As shown in these figures, an inlet valve 60 may be installed at the inlet of the fire extinguishing agent cylinder 50, which the compressed air enters, and the air hose 43 may be connected to the inlet valve 60.

That is, the air hose 43 is connected to the inlet of the fire extinguishing agent cylinder 50 through the inlet valve 60.

The inlet valve 60 is an electronic valve provided to be opened and closed based on the control signal output from the controller 20, and is provided to control supply of the compressed air from the air tank 42 to the fire extinguishing agent cylinder 50.

The inlet valve 60 may be installed between the air hose 43 and an inlet port 59 of the fire extinguishing agent cylinder 50, as exemplarily shown in these figures, or be installed partway along the air hose 43 between air tank 42 and the fire extinguishing agent cylinder 50.

The inlet valve 60 may have a valve body installed at the inlet of the fire extinguishing agent cylinder 50 to open and close an inner passage (the inner passage of the valve body), through which the compressed air passes, and be a solenoid valve in which the valve body is operated by a solenoid to open and close the inner passage of the valve body.

In the present disclosure, the controller 20 outputs a control signal for opening the inlet valve 60 upon determining that a fire breaks out, and when the inlet valve 60 is opened in response to the control signal, the compressed air from the air tank 42 may be supplied to the inside of the fire extinguishing agent cylinder 50 through the air hose 43.

In the present disclosure, the spray nozzle assembly 80 is fixedly installed in the inner space of the vehicle, i.e., the engine compartment, and is connected to an outlet of the fire extinguishing agent cylinder 50 through the fire extinguishing agent hose 76.

The spray nozzle assembly 80 is provided to spray the fire extinguishing agent, supplied from the fire extinguishing agent cylinder 50 through the fire extinguishing agent hose 76, to the inside of the engine compartment to extinguish the fire breaking out in the engine compartment.

In one embodiment of the present disclosure, the spray nozzle assembly 80 may include spray pipes 81 installed in the engine compartment to be disposed along a predetermined path, and a plurality of nozzles 82 installed along the spray pipes 81, as shown in FIG. 3.

The spray pipes 81 of the spray nozzle assembly 80 may be fixedly installed on a stationary structure located in the inner space of the vehicle, for example, a vehicle body located in the engine compartment.

The nozzles 82 of the spray nozzle assembly 80 are provided to spray the fire extinguishing agent, supplied from the fire extinguishing agent cylinder 50 to the spray pipes 81 through the fire extinguishing agent hose 76, to the inside of the engine compartment, and the nozzles 82 are installed at designated intervals along the spray pipes 81 to uniformly spray the fire extinguishing agent to the inside of the engine compartment.

Hereinafter, the fire extinguishing agent cylinder will be described in more detail with reference to FIGS. 9 to 12.

FIG. 9 illustrates a state in which the inside of the fire extinguishing agent cylinder 50 is filled with the fire extinguishing agent, the fire extinguishing agent cylinder 50 includes the fire extinguishing agent tank 51, and the fire extinguishing agent chamber C2 of the fire extinguishing agent tank 51 is filled with the fire extinguishing agent when the piston 74 in the fire extinguishing agent tank 51 is in a retracted state.

FIG. 10 illustrates a state in which the compressed air is supplied to the inside of the fire extinguishing agent cylinder 50 and thus the fire extinguishing agent is discharge to the outside, when the compressed air is supplied to the air chamber C1 of the fire extinguishing agent tank 51 through the inlet port 59, the piston 74 is moved forwards by the pressure of the compressed air in the fire extinguishing agent tank 51 and, at this time, the piston 74 pressurizes the fire extinguishing agent in the fire extinguishing agent chamber C2 and thereby the fire extinguishing agent is discharged from the fire extinguishing agent chamber C2 to the fire extinguishing agent hose 76 through an outlet port 61.

Figure 11:
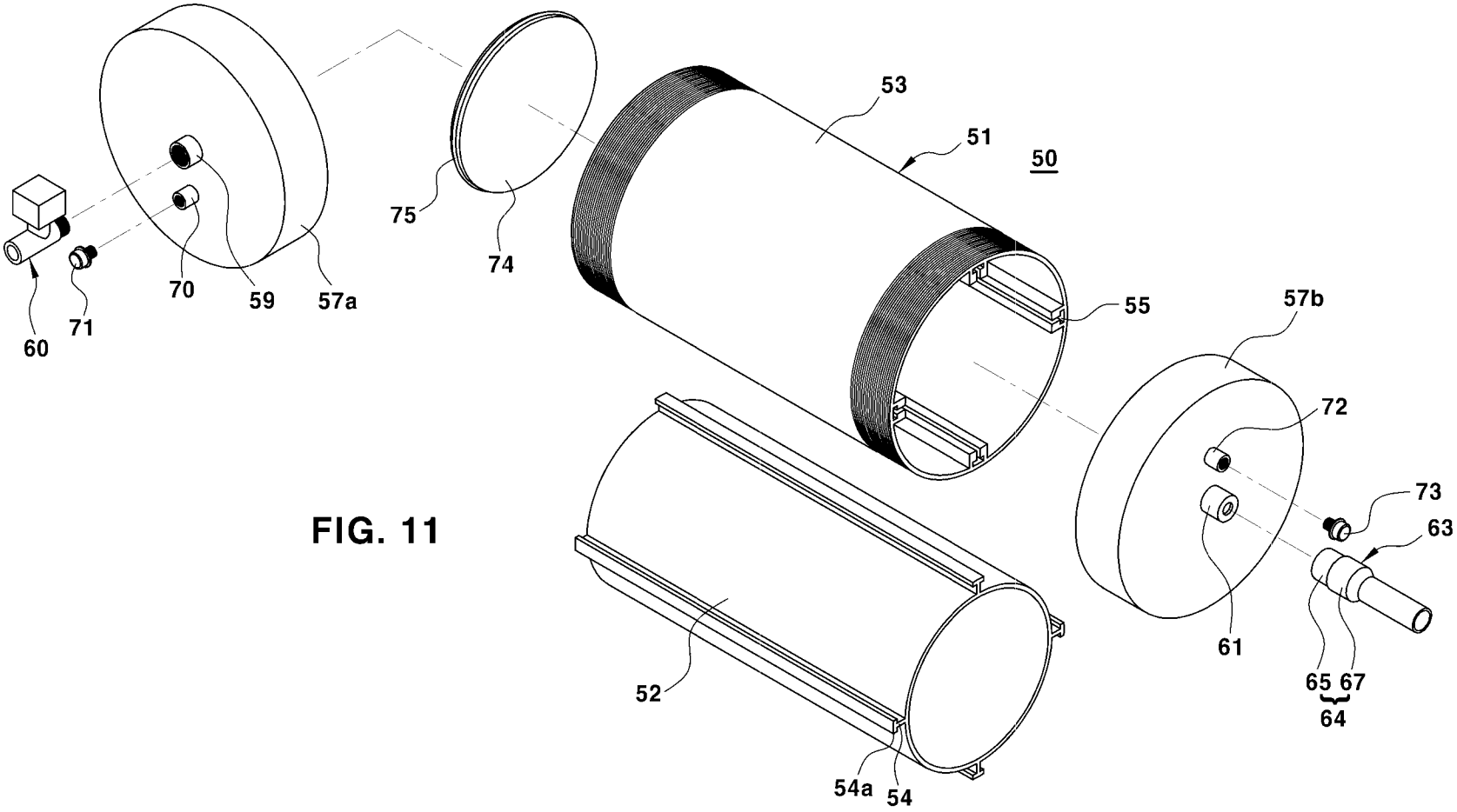
FIG. 11 is an exploded perspective view illustrating the configuration of the fire extinguishing agent cylinder in the fire extinguishing system according to one embodiment of the present disclosure.
Figure 12:
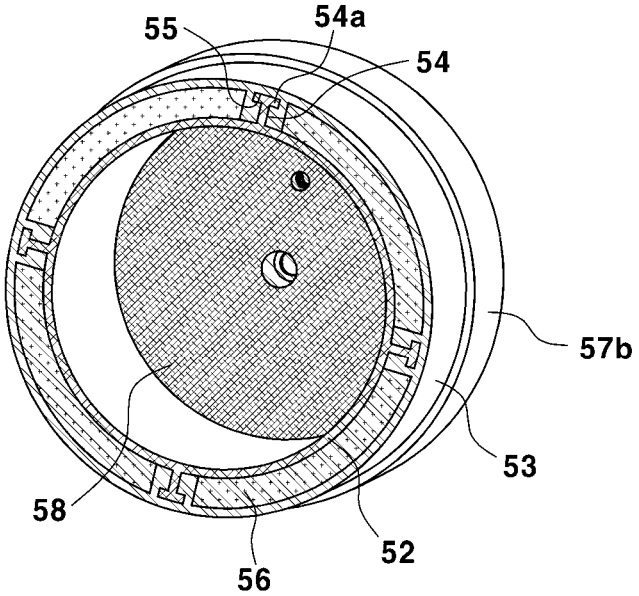
FIG. 12 is a perspective cross-sectional view illustrating the cross-sectional structure of a fire extinguishing agent tank in the fire extinguishing system according to one embodiment of the present disclosure.

FIG. 11 is an exploded perspective view illustrating the configuration of the fire extinguishing agent cylinder in the fire extinguishing system according to one embodiment of the present disclosure, and FIG. 12 is a perspective cross-sectional view illustrating the cross-sectional structure of a fire extinguishing agent tank in the fire extinguishing system according to one embodiment of the present disclosure.

In the present disclosure, the fire extinguishing agent may be a fire extinguishing agent in a liquid state, i.e., a fire extinguishing fluid, and be stored in the fire extinguishing agent cylinder 50.

As shown in these figures, the fire extinguishing agent cylinder 50 includes the fire extinguishing agent tank 51 configured to have an inner space having a designated volume, the inlet valve 60 installed at the inlet of the fire extinguishing agent tank 51, an outlet valve 63 installed at the outlet of the fire extinguishing agent tank 51, and the piston 74 operated in the inner space of the fire extinguishing agent tank 51 by the compressed air (the operating gas) supplied through the inlet port 59 to pressurize the fire extinguishing agent to discharge the fire extinguishing agent through the outlet port 61.

Here, the inlet valve 60 is an electronic valve configured to open and close the inlet of the fire extinguishing agent cylinder 50 (particularly, the fire extinguishing agent tank 51) in response to a control signal from the controller 20, as described above.

In case of a fire, when the inlet valve 60 is opened by the control signal output from the controller 20, the compressed air of a high pressure may be supplied from the air tank 42 to the air chamber C1 in the fire extinguishing agent tank 51 through the air hose 43.

The fire extinguishing agent tank 51 may be a tank having a cylindrical shape, the inlet port 59 to which the compressed air is supplied is provided at one end of the fire extinguishing agent tank 51, and the outlet port 61 from which the fire extinguishing agent is discharged is provided at the other end of the fire extinguishing agent tank 51.

In one embodiment of the present disclosure, the fire extinguishing agent tank 51 may have a double-tube structure in which an inner tube and an outer tube are disposed to be spaced apart from each other by a designated interval.

In more detail, the fire extinguishing agent tank 51 includes a main body 52, serving as an inner tube, configured to have a cylindrical shape with both ends open, a protective cover 53, serving as an outer tube, spaced apart from the outer surface of the main body 52 by a predetermined interval to surround the main body 52 and configured to have a cylindrical shape with both ends open, and caps 57*a* and 57*b* respectively coupled to both ends of the protective covers 53 to close the main body 52.

As shown in FIG. 11, each of the main body 52 serving as the inner tube of the fire extinguishing agent tank 51 and the protective cover 53 serving as the outer tube of the fire extinguishing agent tank 51 may have a cylindrical tubular shape, both ends of which are open, and the main body 52 and the protective cover 53 are assembled to be disposed at inner and outer concentric positions.

That is, the main body 52 and the protective cover 53 are assembled such that the main body 52 is disposed at an inner position and the protective cover 53 is disposed at an outer position, and the main body 52 and the protective cover 53 disposed concentrically are spaced apart from each other by the predetermined interval.

For this purpose, the outer circumferential surface of the main body 52 and the inner circumferential surface of the protective cover 53 may be connected by connection parts 54, and the main body 52 and the protective cover 53 may be coupled to each other with the predetermined interval therebetween by protrusions 54*a* formed on the connection parts 54 and connection groves 55 into which the protrusions 54*a* are inserted.

In more detail, the connection parts 54 protrude from one of the outer circumferential surface of the main body 52 and the inner circumferential surface of the protective cover 53 to connect the two circumferential surfaces while maintaining the interval therebetween, and the protrusions 54*a* are formed at the ends of the connection parts 54.

Further, the connection grooves 55, into which the ends of the connection parts 54 including the protrusions 54*a* are inserted, are formed in the other of the outer circumferential surface of the main body 52 and the inner circumferential surface of the protective cover 53.

In the embodiment shown in FIGS. 11 and 12, the connection parts 54 are formed on the outer circumferential surface of the main body 52, the connection grooves 55 are formed in the inner circumferential surface of the protective cover 53, and the connection parts 54 and the connection grooves 55 are formed at corresponding positions of corresponding regions of the opposing surfaces of the main body 52 and the protective cover 53.

Unlike the embodiment shown in FIGS. 11 and 12, although are not shown in the drawings, the connection grooves 55 may be formed in the outer circumferential surface of the main body 52, and the connection parts 54 may formed on the inner circumferential surface of the protective cover 53.

In the embodiment of the present disclosure, a plurality of connection parts 54 may be formed on one of the outer circumferential surface of the main body 52 and the inner circumferential surface of the protective cover 53, and a plurality of connection grooves 55 may be formed at corresponding position of the other of the outer circumferential surface of the main body 52 and the inner circumferential surface of the protective cover 53.

In one embodiment of the present disclosure, a plurality of connection parts 54 and a plurality of connection grooves 55 may be formed on the surfaces of the main body 52 and the protective cover 53 to continuously extend parallel to each other in the axial direction, i.e., in the length direction of the main body 52 and the protective cover 53.

In one embodiment of the present disclosure, the protrusions 54*a* of the connection parts 54 may protrude from the ends of the connection parts 54 in the width direction of the connection parts 54.

That is, the protrusions 54*a* protrude bilaterally from the ends of the respective connection parts 54, and the connection grooves 55 and the connection parts 54 including the protrusions 54*a* are formed to have a regular cross-sectional shaped throughout the length direction.

In a state in which the ends of the connection parts 54 including the protrusions 54*a* are inserted into the connection grooves 55, the ends of the connection parts 5 including the protrusions 54*a* are slidable in the connection grooves 55 in the length direction thereof.

Accordingly, when the main body 52 is assembled into the protective cover 53, the main body 52 and the protective cover 53 are coupled to each other so that the main body 52 is located inside the protective cover 53 by inserting the ends of the connection parts 54 including the protrusions 54*a* into the connection grooves 55 and then sliding the ends of the connection parts 54 including the protrusions 54*a* along the connection grooves 55.

Thereby, the main body 52 and the protective cover 53 may be coupled to each other, and particularly, the main body 52 and the protective cover 53 may be disposed at inner and outer positions such that they are spaced apart from each other at the predetermined interval.

In one embodiment of the present disclosure, the connection parts 54 provided in a designated number and the connection grooves 55 provided in the same number may be disposed at the same interval in the circumferential direction of the main cover 52 and the protective cover 53, and, in the embodiment shown in FIGS. 11 and 12, four connection parts 54 and four connection grooves 55 are disposed at an interval of 90° in the circumferential direction.

This is merely one example, and thus, the present disclosure is not limited thereto and the number of the connection parts 54 and the connection grooves 55 and the interval therebetween are changeable.

The reason why the fire extinguishing agent tank 51 has a double-tube structure is that, if the fire extinguishing agent tank 51 includes only the main body 52, when the fire extinguishing agent tank 51 is assembled, the main body 52 may be punctured, and in this case, the piston 74 may catch on the punctured part and become unable to move.

Therefore, the protective cover 53 is disposed outside the main body 52 to protect the main body 52, and the main body 52 and the protective cover 53 are spaced apart from each other to prevent damage to the main body 52 even when an impact is applied to the protective cover 53.

In one embodiment of the present disclosure, an insulator 56 may be inserted into a space between the main body 52 and the protective cover 53, thereby being capable of increasing the heat-resistant temperature that the fire-extinguishing agent tank 51 and the fire-extinguishing agent cylinder 50 are capable of withstanding.

In the conventional fire extinguishing system, since the insulator 56 is not applied to the fire extinguishing agent cylinder 5, the heat-resistant temperature of the fire extinguishing agent cylinder 5 is relatively low, i.e., is equal to or lower than 70° C. but the internal temperature of the engine compartment of a bus is generally is equal to or higher than 80° C., and thus, it is difficult to install the fire extinguishing agent cylinder 5 in the engine compartment.

Therefore, a separate compartment in which the fire extinguishing agent cylinder 5 is installed, other than the engine compartment, must be prepared, and thus, it is difficult to design the layout of a vehicle. Moreover, the length of a hose for connecting the spray nozzle assembly 6 to the fire extinguishing agent cylinder 5 is increased, thereby causing disadvantages in terms of arrangement of parts and cost.

On the other hand, in the present disclosure, the fire extinguishing agent tank 51 of the fire extinguishing agent cylinder 50 is configured to have a double-tube structure and the insulator 56 is installed in the space between the main body 52 and the protective cover 53, and thus, the fire extinguishing agent cylinder 50 may be mounted in the high-temperature engine compartment and have a high heat-resistant temperature to be capable of being mounted in various spaces, thereby being advantageous in terms of layout design.

The caps 57*a* and 57*b* are coupled to both ends of the protective cover 53 to which the main body 52 is coupled, and the caps 57*a* and 57*b* may seal the inner spaces of the main body 52 and the protective cover 53.

In one embodiment of the present disclosure, the caps 57*a* and 57*b* are engaged with both ends of the protective cover 53 using screw threads, and, for this purpose, screw threads are formed on the inner circumferential surfaces of the caps 57*a* and 57*b* and the outer circumferential surfaces of the two ends of the protective cover 53 and thus the inner circumferential surfaces of the caps 57*a* and 57*b* may be engaged with the outer circumferential surfaces of the two ends of the protective cover 53 using the screw threads.

When the caps 57*a* and 57*b* are respectively engaged with the ends of the front cover 53 using the screw threads, both ends of the main body 52 are pressed against the inner surfaces of the respective caps 57*a* and 57*b* and thus seal the inner space of the main body 52.

Here, to increase adhesion between inner surfaces of the respective caps 57*a* and 57*b* and both ends of the main body 52 and to prevent leakage of the fire extinguishing agent through gaps between the caps 57*a* and 57*b* and both ends of the main body 52, pads 58 formed of an elastic material to seal the gaps between the caps 57*a* an 57*b* and both ends of the main body 52 may be adhered to the inner surfaces of the respective caps 57*a* and 57*b*, which the ends of the main body 52 contact, and the pads 58 may be rubber pads 58.

Thereby, after the piston 74 is installed in the main body 52 in the assembled state of the main body 52 and the protective cover 53, the respective caps 57*a* and 57*b* are engaged with both ends of the main body 52 using the screw threads, thereby sealing the inner space of the main body 52.

Here, both ends of the main body 52 are pressed against to the pads 58 adhered to the inner surfaces of the caps 57*a* and 57*b*, thereby being capable of eliminating the gaps between the caps 57*a* and 57*b* and both ends of the main body 52 and causing the fire extinguishing agent to fill the inner space of the main body 52, which is completely sealed, to prevent leakage of the fire extinguishing agent.

In one embodiment of the present disclosure, among the two caps 57*a* and 57*b*, one is an inlet cap 57*a* and the other is an outlet cap 57*b*.

Further, the inlet port 59 having an outwardly protruding shape may be formed at the inlet cap 57*a*, the inlet port 59 may serve as the inlet port of the fire extinguishing agent cylinder 50 and the inlet port of the fire extinguishing agent tank 51, and the air hose 43 may be connected to the inlet port 59 by the inlet valve 60.

Further, the outlet port 61 having an outwardly protruding shape may be formed at the outlet cap 57*b*, the outlet port 61 may serve as the outlet port of the fire extinguishing agent cylinder 50 and the outlet port of the fire extinguishing agent tank 51, and the fire extinguishing agent hose 76 may be connected to the outlet port 61 by the outlet valve 63.

In addition, an air discharge port 70 connected to the air chamber C1 formed by the main body 52 is separately formed at the inlet cap 57*a*, a filling port 72 connected to the fire extinguishing agent chamber C2 formed by the main body 52 is separately formed at the outlet cap 57*b*, and plugs 71 and 73 are detachably coupled to the air discharge port 70 and the filling port 72 to seal the air discharge port 70 and the filling port 72.

Here, the plugs 71 and 73 may serve as stoppers to close inner passages of the respective ports 70 and 72 and be provided to be inserted into the corresponding ports 70 and 72 and then to be engaged therewith using screw threads, and, for this purpose, screw threads are formed on the inner circumferential surfaces of the respective ports 71 and 73 and the outer circumferential surfaces of the bodies of the respective plugs 70 and 72 inserted into the ports 71 and 73.

The piston 74 is provided in a plate shape having a predetermined thickness, as shown in FIG. 10, and is installed laterally within the fire extinguishing agent cylinder 50, particularly, in the inner space of the main body 52 of the fire extinguishing agent tank 51 of the fire extinguishing agent cylinder 50.

The piston 74 divides the inner space of the main body 52 into two chambers. The inner space of the main body 52 is divided into the air chamber C1, to which air is supplied to be filled with the air when the inlet valve 60 is opened, and the fire extinguishing agent chamber C2, which is filled with the fire extinguishing agent, by the piston 74 installed laterally.

That is, the inner space of the fire extinguishing agent tank 51 is divided into the air chamber C1 and the fire extinguishing agent chamber C2 by the piston 74, and to completely divide and separate the two chambers C1 and C2 from each other, the shape of the piston 74 must be equal to the cross-sectional shape of the main body 52. That is, if the main body 52 has a circular cross-sectional shape, the piston 74 must has a circular shape.

Further, an O-ring 75 may be installed on the circumferential surface of the piston 74 contacting the inner surface of the main body 52 to maintain airtightness with the inner surface of the main body 52.

The piston 74 is moved to push the compressed air to spray the fire extinguishing agent using the pressure of the compressed air when the compressed air is supplied to the inside of the fire extinguishing agent tank 51, and serves as a pressure transmitting plate which transmits the pressure of the compressed air supplied to the air chamber C1 to the fire extinguishing agent filling the fire extinguishing agent chamber C2 to pressurize the fire extinguishing agent.

Accordingly, as exemplarily shown in FIG. 9, after the piston 74 is moved maximally rearwards to ensure the maximum volume of the fire extinguishing chamber C2 and the filling port 72 is opened by removing the plug 73 therefrom, the fire extinguishing agent chamber C2 may be filled with the fire extinguishing agent through the opened filling port 72.

After filling the fire extinguishing agent chamber C2 with the fire extinguishing agent, the filling port 72 is closed by coupling the plug 73 thereto again.

When an operation for extinguishing a fire is performed, the inlet valve 60 is opened, the compressed air is injected into the fire extinguishing agent cylinder 50, i.e., the air chamber C1 in the main body 52 of the fire extinguishing agent tank 51, through the inlet port 59, and the injected compressed air pushes the piston 74.

Here, the piston 74 is moved forwards by the pressure of the compressed air, the moving piston 74 pressurizes the fire extinguishing agent filling the fire extinguishing agent chamber C2 of the main body 52 to push the fire extinguishing agent through the outlet port 61, and the fire extinguishing agent is sprayed into the engine compartment through the spray nozzle assembly 80, thereby extinguishing the fire.

When spray of the fire extinguishing agent due to the piston 74 moved forwards in the main body 52 and extinguishing of the fire thereby have been completed, the fire extinguishing agent chamber C2 of the main body 52 may be refilled with the fire extinguishing agent.

For this purpose, the air discharge port 70 is opened by removing the plug 71 therefrom, the filling port 72 is opened by removing the plug 73 therefrom, and the fire extinguishing agent chamber C2 is filled again with the fire extinguishing agent through the filling port 72.

While the fire extinguishing agent chamber C2 is filled again with the fire extinguishing agent, the compressed air in the air chambers C1 is discharged through the air discharge port 70 and simultaneously the piston 76 is moved rearwards, and thereafter, the fire extinguishing agent chamber C2 is filled with the fire extinguishing agent until the piston 74 is moved maximally rearwards.

After maximally filling the fire extinguishing agent chamber C2 with the fire extinguishing agent, the filling port 72 is closed by coupling the plug 73 thereto again and the air discharge port 70 is closed by coupling the plug 71 thereto again. Thereby, the refilling process of the fire extinguishing agent is completed.

In the conventional fire extinguishing system, the fire extinguishing agent cylinder 5 has a structure in which a metal membrane is punctured when the pressure of the fire extinguishing agent reaches a designated pressure value or more, like the nitrogen tank 3, and therefore, after the fire extinguishing agent cylinder 5 is used when a fire breaks out, the entire fire extinguishing agent cylinder 5 must be replaced.

On the other hand, in the fire extinguishing system according to the present disclosure, since the air discharge port 70 and the filling port 72 may be opened by respectively removing the corresponding plugs 71 and 73 therefrom and then the fire extinguishing agent chamber C2 may be refilled with the fire extinguishing agent, the fire extinguishing agent chamber C2 may be simply refilled with the fire extinguishing agent without replacement of the fire extinguishing agent tank 51, and thus maintenance cost may be reduced.

In one embodiment of the present disclosure, the outlet valve 63 is installed at the outlet port 61 of the fire extinguishing agent cylinder 50, as described above, and the outlet valve 63 may have the configuration of a safety valve which opens an inner passage when pressure of a predetermined pressure level or more is applied thereto, and the configuration of a check valve which prevents overflow of a fluid.

The main function of the outlet valve 63 is to close the outlet port 61 of the fire extinguishing agent tank 51 at normal times, and to open the outlet port 61 when the piston 74 is moved forwards by the pressure of the compressed air in the fire extinguishing agent tank 51 and pressurizes the fire extinguishing agent in the fire extinguishing agent chamber C2 during the fire extinguishing operation and thereby the pressure of the fire extinguishing agent becomes equal to or higher than a designated pressure level.

For this purpose, the outlet valve 63 is configured to maintain the closed state thereof at normal times when the pressure of the fire extinguishing agent in the fire extinguishing agent chamber C2 is not great, and to be opened when the pressure of the fire extinguishing agent becomes equal to or higher than the designated pressure level (for example, 8-9 bar).

Figure 13:
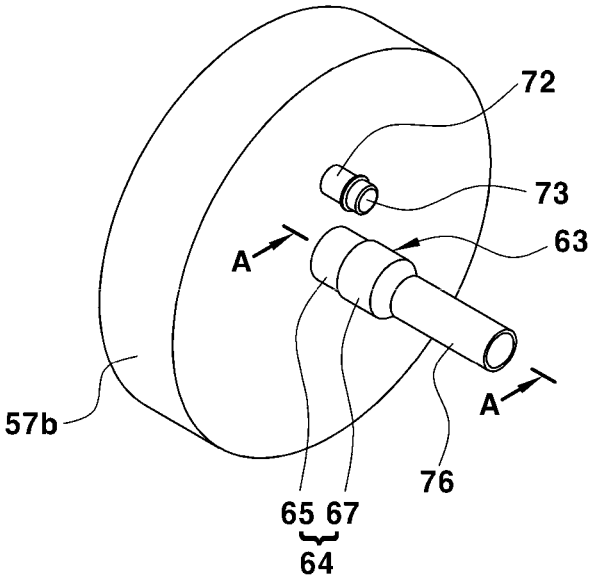
FIG. 13 is a perspective view illustrating a state in which an outlet valve of the fire extinguishing agent cylinder is installed in the fire extinguishing system according to one embodiment of the present disclosure.
Figure 14:
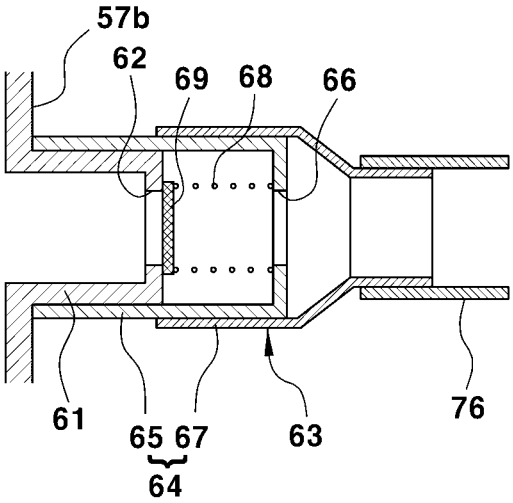
FIGS. 14 and 15 are cross-sectional view illustrating the operating state of the outlet valve in the fire extinguishing system according to one embodiment of the present disclosure.
Figure 15:
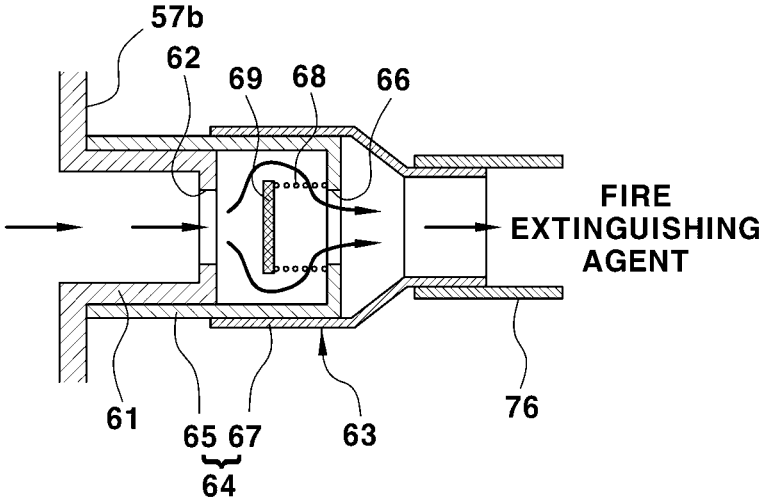

FIG. 13 is a perspective view illustrating a state in which the outlet valve of the fire extinguishing agent cylinder is installed in the fire extinguishing system according to one embodiment of the present disclosure, and FIGS. 14 and 15 are cross-sectional view illustrating the operating state of the outlet valve in the fire extinguishing system according to one embodiment of the present disclosure.

FIGS. 14 and 15 are cross-sectional views taken along line A-A' of FIG. 13, FIG. 14 illustrates the closed state of the outlet valve 63, and FIG. 15 illustrates the opened state of the outlet valve 63.

In one embodiment of the present disclosure, the outlet valve 63 includes a hose connection adaptor 64, which is installed at the outlet port 61 of the fire extinguishing agent cylinder 50 and is connected to the fire extinguishing agent hose 76, an opening and closing member 69 installed in the hose connection adaptor 64 to open and close an outlet hole 62 of the outlet port 61 and moved to open the outlet hole 62 of the outlet port 61 by the pressure of the fire extinguishing agent, which is equal to or higher than the predetermined pressure level, applied thereto, and a valve spring 68 installed in the hose connection adaptor 64 to elastically support the opening and closing member 69 and provided to apply elastically restoring force to the opening and closing member 69 in the direction of closing the outlet hole 62 of the outlet port 61.

In more detail, as shown in FIG. 13, the hose connection adaptor 64 is installed at the outlet port 61 of the fire extinguishing agent cylinder 50, i.e., the outlet port 61 having a cylindrical shape provided at the outlet cap 57*b* of the fire extinguishing agent tank 51, and the fire extinguishing agent hose 76 is connected to the hose connection adaptor 64.

The hose connection adaptor 64 connects the fire extinguishing agent hose 76 to the outlet port 61 of the fire extinguishing agent cylinder 50, and serves as a valve housing of the outlet valve 63.

As shown in FIGS. 14 and 15, the hose connection adaptor 64 may include a mounting cap 65 configured to have a cylindrical shape and engaged with the outer circumferential surface of the outlet port 61 using screw threads, and an adaptor housing 67 configured to have a cylindrical shape and engaged with the outer circumferential surface of the mounting cap 65 using screw threads.

With this configuration, the mounting cap 65 of the hose connection adaptor 64 serves as a valve housing, and the remaining parts of the outlet valve 63 are installed within the mounting cap 65.

The inner passage of the outlet port 61 of the fire extinguishing agent tank 51 communicates with the fire extinguishing agent chamber C2 of the fire extinguishing agent tank 51, which is filled with the fire extinguishing agent, and the outlet hole 62 is formed through the center of the end of the outlet port 61.

Further, a discharge hole 66 is formed through the center of one end of the mounting cap 65 coupled to the outer portion of the outlet port 61, and a space is formed between the end of the mounting gap 65 and the end of the outlet port 61.

The valve spring 68 and the opening and closing member 69 supported by the valve spring 68 to open and close the outlet hole 62 of the outlet port 61 are installed in this space.

One end of the valve spring 68 is supported by the inner surface of the end of the mounting cap 65, and the other end of the valve spring 68 is connected to the opening and closing member 69. When the pressure of the fire extinguishing agent does not reach the predetermined pressure level, as shown in FIG. 14, the opening and closing member 69 supported by the valve spring 68 is pressed against the outer surface of the end of the outlet port 61, and thereby, closes the outlet hole 62 of the outlet port 61.

On the other hand, when the pressure of the fire extinguishing agent filling the fire extinguishing agent chamber C2 of the fire extinguishing agent tank 51 and the inner passage of the outlet port 61 reaches the predetermined pressure level, as shown in FIG. 15, the opening and closing member 69 is moved against the force of the valve spring 68 by the pressure of the fire extinguishing agent, and thereby, opens the outlet hole 62 of the outlet port 61.

As shown in FIG. 15, when the pressure of the fire extinguishing agent reaches the predetermined pressure level, the opening and closing member 69 moves forwards while compressing the valve spring 68, and at this time, when the opening and closing member 69 is spaced apart from the end of the outlet port 61 and thus opens the outlet hole 62, the fire extinguishing agent discharged through the outlet hole 62 from the outlet port 61 is discharged to the inside of the adaptor housing 67 through the discharge hole 66 of the mounting cap 65 via a space formed around the opening and closing member 69 in the mounting cap 65.

Consequently, the fire extinguishing agent discharged to the inside of the adaptor housing 67 may be supplied to the spray nozzle assembly 80 through the fire extinguishing agent hose 76.

As such, the configuration of the fire extinguishing system according to one embodiment of the present disclosure has been described. Now, the operating state of the fire extinguishing system will be described below.

First, when a fire breaks out in the engine compartment, the fire sensing unit 10 senses outbreak of the fire, and the controller 20 recognizes outbreak of the fire in the engine compartment by receiving a fire sensing signal transmitted from the fire sensing unit 10.

Here, the controller 20 operates an alarm device 30 installed in the vehicle, thereby informing the driver of the vehicle of outbreak of the fire in the engine compartment.

Here, the alarm device 30 may include at least one of a sound output device, a display device or a lamp which is installed in the vehicle and operated to indicate outbreak of the fire in the engine compartment in response to a control signal output from the controller 20.

The sound output device may be a buzzer installed on the interior part or the exterior part of the vehicle, the display device may be a display installed on a cluster or other in-vehicle displays (for example, an AVN display), and the lamp may be a warning lamp installed on the interior part or the exterior part of the vehicle.

Simultaneously, the controller 20 outputs a control signal for spraying the fire extinguishing agent, the inlet valve 60 is opened in response to the control signal output from the controller 20, and, when the inlet valve 60 is opened, the compressed air stored in the air tank 42 is supplied to the fire extinguishing agent cylinder 50 through the air hose 43.

Here, the compressed air is supplied to the air chamber C1 in the fire extinguishing agent tank 51 through the inlet of the fire extinguishing agent cylinder 50, i.e., the inlet port 59 of the fire extinguishing agent tank 51, and the piston 74 is moved forwards by the pressure of the compressed air and thus pushes the fire extinguishing agent filling the inside of the fire extinguishing agent chamber C2.

Simultaneously, the controller 20 operates the air compressor 41 to maintain constant pressure of the compressed air supplied from the air tank 42, thereby avoiding a pressure drop.

When the pressure of the fire extinguishing agent reaches the predetermined pressure level, the outlet valve 63 is opened, and the fire extinguishing agent in the fire extinguishing agent tank 51 is supplied to the fire extinguishing agent hose 76 through the hose connection adaptor 64 and is consequently sprayed to the inside of the engine compartment through the spray nozzle assembly 80, thereby extinguishing the fire.

Thereafter, when a predetermined time from a point in time when the inlet valve 60 is opened has elapsed, the controller 20 closes the inlet valve 60.

For example, on the assumption that it takes 40 seconds to spray 10 liters of the fire extinguishing agent stored in the fire extinguishing agent tank 51 through the spray nozzle assembly 80, the controller 20 may be set to automatically close the inlet valve 60 two minutes after the point in time when the inlet valve 60 is opened.

As is apparent from the above description, a fire extinguishing system for vehicles according to the present disclosure may automatically sense outbreak of a fire in a vehicle to rapidly and effectively extinguish the fire.

Particularly, the fire extinguishing system for vehicles according to the present disclosure uses compressed air in an air tank, which is already mounted in a vehicle, as operating gas, and has a structure in which a fire extinguishing agent cylinder is easily filled again with a fire extinguishing agent, and thus does not require provision of an expensive pressure tank configured to store nitrogen and accessories thereof and replacement of the tank or the cylinder, thereby greatly reducing installation cost and maintenance cost.

Further, a fire sensing line used in the fire extinguishing system for vehicles according to the present disclosure uses an MR fluid, and may thus differentiate heat-resistant temperature characteristics depending on the mounting position of the fire sensing line in the vehicle and usage conditions, such as the temperature of a space in which the fire sensing line is mounted or a required temperature to detect a fire, without changing a material which is used for the fire sensing line and the configuration of the fire sensing line, and may adjust a sensed temperature range depending on the usage conditions.

In addition, malfunction of the fire extinguishing system may be prevented and operational reliability of the fire extinguishing system may be improved through improvement of rigidity and durability of the fire sensing line.

The disclosure has been described in detail with reference to preferred embodiments thereof. However, it will be appreciated by those skilled in the art that changes may be made in these embodiments without departing from the principles and spirit of the disclosure, the scope of which is defined in the appended claims and their equivalents.

What is claimed is:

1. A fire extinguishing system for a vehicle, the fire extinguishing system comprising:

a fire sensing line arranged in a predetermined space of the vehicle to output a fire sensing signal as an electrical signal when a fire is sensed;

a controller configured to output a control signal for spraying a fire extinguishing agent when the fire sensing signal from the fire sensing unit is input;

a fire extinguishing agent cylinder configured to be operated to discharge the fire extinguishing agent filling an inside of the fire extinguishing agent cylinder in response to the control signal outputted from the controller; and a spray nozzle assembly arranged in the predetermined space of the vehicle and configured to spray the fire extinguishing agent supplied from the fire extinguishing agent cylinder through a fire extinguishing agent hose, wherein the fire sensing line comprises:

a tube comprising a first hollow part and a second hollow part extending in a length direction of the tube;

two electrically conductive wires disposed along the first hollow part to be respectively covered with a covering material to be electrically isolated from each other, and configured to be short-circuited when a current is applied thereto and configured to input a short-circuit signal as the fire sensing signal to the controller;

a coil configured to receive a current, and arranged in the length direction of the tube inside or outside the tube;

a magneto-rheological (MR) fluid configured to fill an inside of the second hollow part of the tube; and an outer conduit disposed to surround the tube, and wherein the current applied to the two electrically conductive wires and the current received by the coil are controlled and supplied, respectively, by the controller.

2. The fire extinguishing system of claim 1, wherein the first hollow part and the second hollow part are defined to be parallel with each other within the tube.

3. The fire extinguishing system of claim 1, wherein the coil is disposed within the second hollow part filled with the MR fluid to spirally surround the two electrically conductive wires.

4. The fire extinguishing system of claim 1, wherein the coil is configured to be spirally wound on an outer circumferential surface of the tube, and is located in a space between the tube and the outer conduit.

5. The fire extinguishing system of claim 1, wherein the tube comprises an inner tube, and an outer tube disposed outside the inner tube, wherein a sealed space is defined between the inner tube and the outer tube to be configured as the second hollow part that is filled with the MR fluid.

6. The fire extinguishing system of claim 5, wherein the first hollow part is defined in the inner tube.

7. The fire extinguishing system of claim 5, wherein at least one third hollow part corresponding to an empty space extending in the length direction of the tube is defined in the inner tube.

8. The fire extinguishing system of claim 1, wherein the controller is configured to control a magnitude of the current received by the coil.

9. The fire extinguishing system of claim 1, further comprising:

an air tank configured to store compressed air; and an air hose configured to connect the air tank to the fire extinguishing agent cylinder, wherein the fire extinguishing agent cylinder is configured to discharge the fire extinguishing agent by the compressed air supplied from the air tank through the air hose.

10. The fire extinguishing system of claim 9, wherein the fire extinguishing agent cylinder comprises an inlet valve arranged at an inlet of the fire extinguishing agent cylinder connected to the air hose, the inlet valve configured to be opened to supply the compressed air from the air hose to an inside of the fire extinguishing agent cylinder through the inlet in response to the control signal output from the controller.

11. The fire extinguishing system of claim 10, wherein the fire extinguishing agent cylinder further comprises an outlet valve arranged at an outlet of the fire extinguishing agent cylinder connected to the fire extinguishing agent hose, the outlet valve configured to be opened to discharge the fire extinguishing agent stored in the fire extinguishing agent cylinder to the fire extinguishing agent hose through the outlet depending on a pressure state of the fire extinguishing agent in the fire extinguishing agent cylinder.

12. The fire extinguishing system of claim 9, wherein the fire extinguishing agent cylinder comprises:

a fire extinguishing agent tank filled with the fire extinguishing agent and comprising:

an inlet port connected to the air hose so that the compressed air is supplied to the fire extinguishing agent tank therethrough; and an outlet port connected to the fire extinguishing agent hose so that the fire extinguishing agent is discharged from the fire extinguishing agent tank therethrough; and a piston arranged to divide an inner space of the fire extinguishing agent tank into an air chamber, to which the compressed air is supplied, and a fire extinguishing agent chamber, to which the fire extinguishing agent is supplied, the piston configured to move by the compressed air supplied to the air chamber to pressurize the fire extinguishing agent filling the fire extinguishing agent chamber to discharge the fire extinguishing agent through the outlet port.

13. The fire extinguishing system of claim 12, wherein the fire extinguishing agent tank comprises:

a main body serving as an inner tube configured such that the piston is arranged therein and having both ends open;

a protective cover serving as an outer tube spaced apart from an outer surface of the main body by a designated interval to surround the main body, and having both ends open; and an inlet cap and an outlet cap coupled to the respective ends of the protective cover to seal the main body.

14. The fire extinguishing system of claim 13, wherein an insulator is disposed in a space between the main body and the protective cover.

15. The fire extinguishing system of claim 13, wherein the inlet cap comprises an air discharge port connected to the air chamber in an inner space of the main body, wherein the outlet cap comprises a filling port connected to the fire extinguishing agent chamber of the inner space of the main body, and wherein a plug for sealing is detachably coupled to each of the air discharge port and the filling port.

16. The fire extinguishing system of claim 1, wherein the predetermined space of the vehicle is configured as an engine compartment.

* * * * *